US005316705A

United States Patent [19]

McNair, Jr. et al.

[11] Patent Number: 5,316,705

[45] Date of Patent: * May 31, 1994

[54] PROCESS FOR THE PRODUCTION OF CELLULOSE ESTER FIBRETS

[75] Inventors: Samuel S. McNair, Jr., Pembroke; David M. Gault, Blacksburg, both of Va.

[73] Assignee: Hoechst Celanese Corporation, Somerville, N.J.

[ * ] Notice: The portion of the term of this patent subsequent to Dec. 29, 2009 has been disclaimed.

[21] Appl. No.: 936,430

[22] Filed: Aug. 27, 1992

Related U.S. Application Data

[63] Continuation of Ser. No. 627,082, Dec. 14, 1990, Pat. No. 5,175,276.

[51] Int. Cl.[5] ..... C08B 3/22; C08B 3/26; C08B 3/28; B29C 67/24

[52] U.S. Cl. ..... 264/5; 536/65; 536/69; 536/85; 536/127

[58] Field of Search ..... 536/64, 63, 65, 76, 536/69, 85, 127; 425/6; 264/5

[56] References Cited

U.S. PATENT DOCUMENTS 4,040,856 8/1977 Litzinger ..... 106/170
4,047,862 9/1977 Keith ..... 425/8
5,175,276 12/1992 McNair, Jr. et al. ..... 536/65

FOREIGN PATENT DOCUMENTS 429739 6/1935 United Kingdom .

OTHER PUBLICATIONS

"Grant and Hackh's Chemical Dictionary", fifth edition, p. 219, McGraw-Hill (1987) (month unavailable).

*Primary Examiner*—John Kight, III
*Assistant Examiner*—Jeffrey Culpeper Mullis
*Attorney, Agent, or Firm*—R. H. Hammer, III

[57] ABSTRACT

An improved process for the production of cellulose ester fibrets wherein a thickened slurry of the fibrets in a liquid mixture of a solvent for the fibrets and a fibret non-solvent is contacted with saturated steam in the separation of the solvent from the fibrets.

8 Claims, 1 Drawing Sheet

PROCESS FOR THE PRODUCTION OF CELLULOSE ESTER FIBRETS

This is a continuation of application Ser. No. 07/627,082 filed Dec. 14, 1990, now U.S. Pat. No. 5,175,276.

This invention relates to an improved process for the production of cellulose ester fibrets In another aspect this invention relates to a process for the production of cellulose ester fibrets substantially free of chips and pills. In yet another aspect the invention relates to an improved cellulose ester fibret process for separating an organic solvent from the produced fibrets.

BACKGROUND OF THE INVENTION

Short fibrillar cellulose ester material (termed fibrets) are employed in a variety of applications such as in the manufacture of tobacco smoke filters and as a replacement for clay and titanium dioxide in paper opacification. Fibrets can be produced using an unstable wet spinning process in which the fibrets are precipitated out of an organic solution of the polymer and formed, in a non-solvent, under controlled conditions. The formed fibrets are in a mixture of the organic solvent and non-solvent. The mixture can then be screened or filtered to increase the fibret concentration and the fibret concentrate thereafter heated to evaporate the organic solvent.

Conventionally, the heating step is conducted indirectly in a steam-jacketed vessel. This method of separating the organic solvent is unsatisfactory because of the formation of large clots of fused fibrets, referred to as "chips", on the heated vessel walls. These chips plug up piping and equipment.

The formation of chips can be eliminated by replacing the indirect heating step with the introduction of live superheated steam into the mixture. The resultant fibrets are chip-free but contain agglomerations of fused fibrets having diameters of less than 1 mm, referred to as "pills".

SUMMARY OF INVENTION

In the production of cellulose ester fibrets an improved process for separating the organic solvent from the produced fibrets is provided, said process improvement comprising directly contacting the fibret, solvent and non-solvent mixture with saturated steam, and recovering therefrom fibrets which are substantially free of chips and pills.

DETAILED DESCRIPTION OF THE INVENTION

Figure 1:
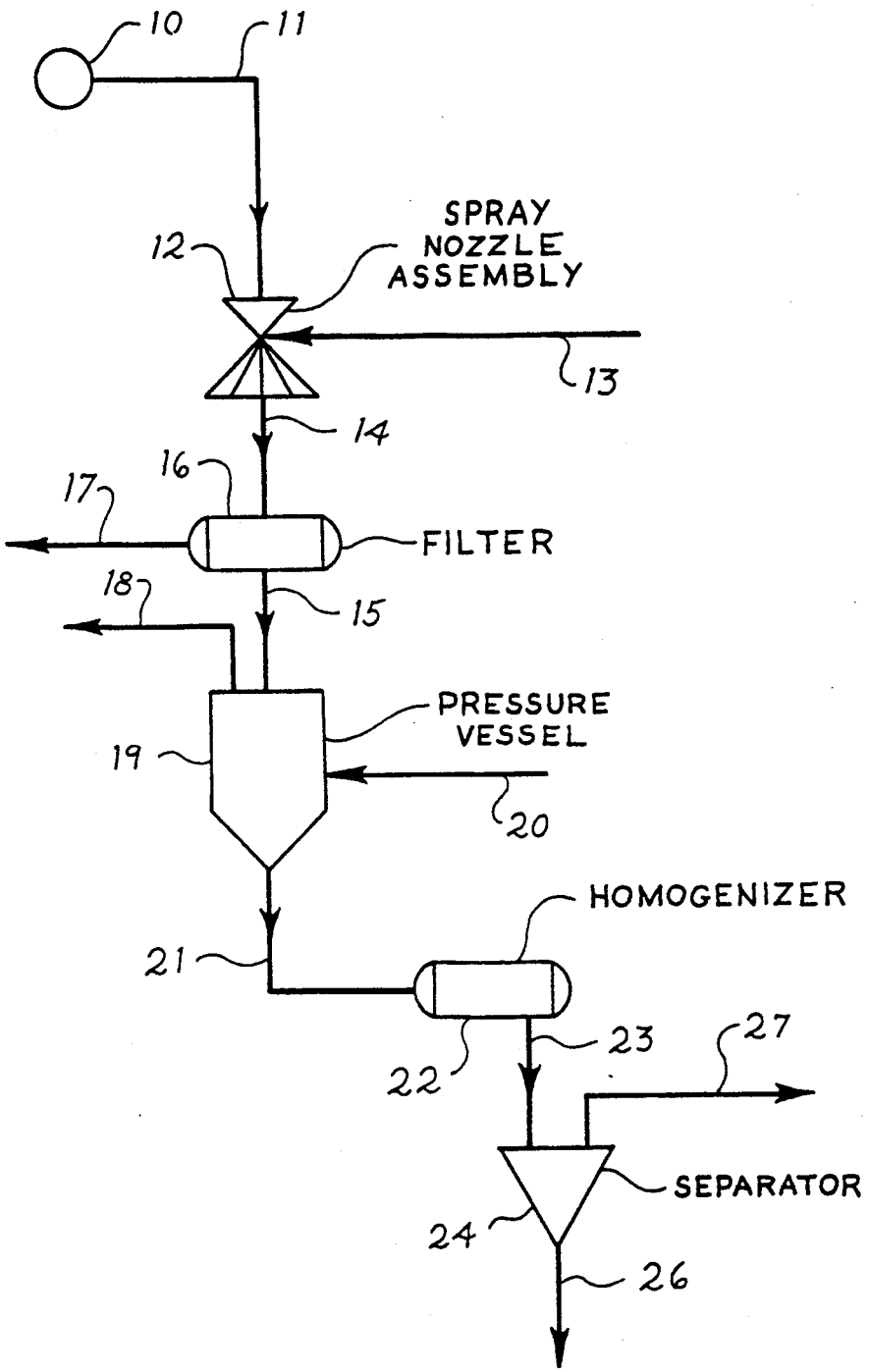
FIG. 1 is a schematic flow sheet of the process of the invention.

Referring to FIG. 1, a supply 10 of cellulose ester in a liquid mixture is prepared, such liquid mixture comprising two miscible components: an organic solvent such as acetone, methyl ethyl ketone, acetaldehyde or ethyl acetate and a miscible liquid non-solvent for the cellulose ester such as water, methanol or ethanol. The liquid non-solvent comprises from about 2 to about 20 percent by weight of the solvent and non-solvent mixture. The preferred organic solvent is acetone which is miscible with the preferred nonsolvent, water.

The cellulose esters of this invention include cellulose acetate, cellulose triacetate, cellulose acetate butyrate, benzyl cellulose, or mixtures thereof with cellulose acetate being the preferred cellulose ester. Preferably, the cellulose esters of this invention are prepared from an acetylation grade wood pulp with higher than 90 percent by weight of hemicellulose. It is also preferred that high purity cellulose esters be employed.

The concentration of cellulose ester in the solvent and nonsolvent mixture should preferably be from about 5 to about 15 percent by weight with the particular concentration of the cellulose ester being dependent upon the method selected to form the fibrets. The cellulose ester, solvent and non-solvent mixture is then introduced into the precipitation non-solvent in a fibret precipitation zone under shearing conditions.

A suitable method for producing the fibrets is described in U.S. Pat. No. 4,192,838 which is incorporated herein by reference thereto. When employing the spray nozzle described therein, the cellulose ester dissolved in the solvent mixture is passed at an elevated temperature and under pressure via line 11 through a capillary needle of spray nozzle assembly 12 situated in the throat of a venturi tube through which a coagulation heated non-solvent is passed from conduit 13. The temperatures of the mixture and non-solvent feeds to the spray nozzle assembly will be dependent upon the selected ester, solvent and non-solvent. When employing cellulose acetate, acetone and water, the temperature in the spray nozzle assembly will normally range from 120° to 170° F.

The shearing high velocity of the non-solvent stream in the venturi throat region attenuates the cellulose ester-solvent mixture and additionally extracts the solvent, forming fibrets. By changing the concentration of the cellulose ester in the solvent and non-solvent mixture, the flow rate of non-solvent, the non-solvent temperature or by adding solvents to the non-solvent stream, the size, degree of fibrillation and length of the fibrets can be controlled. The term "fibret" as employed herein refers to a high surface area, cellulose ester fibrillar material having surface areas in excess of 5.0 square meters per gram, lengths of less than 1000 microns and diameters of from about 0.5 to 50 microns.

Another suitable method of producing the fibrets is described in U.S. Pat. No. 4,047,862, also incorporated herein by reference thereto. As described therein the cellulose acetate, solvent and non-solvent mixture is extruded through an orifice into a heated region of shear and high draw in a precipitation bath containing a non-solvent for the ester.

Mineral additives such as titanium oxide, barium sulfate and aluminum oxide can be included in the cellulose ester-solvent mixture passed to the capillary needle. If included, the concentration of such additives can be up to 75 percent of the weight of the cellulose ester as part of the total solids.

The fibrets as a dilute slurry in the solvent and non-solvent mixture is passed via conduit 14 to a filter means 16. Suitably, filter means 16 can comprise a commercially available screen which forms a thickened slurry of the fibrets which is passed via conduit 15 to a pressure vessel 19. A mixture of the solvent and non-solvent is withdrawn from filter means 16 via conduit 17.

Saturated steam is introduced into pressure vessel 19 via conduit 20 at a rate so as to maintain the hereafter described temperature. The pressure within pressure vessel 20 is normally within the range of about 0 to about 15 pounds per square inch gauge (psig) and the temperature within vessel is such as to separate substantially all of the remaining solvent from the fibrets at the vessel pressure. Normally, when producing cellulose acetate fibrets from an acetone-water mixture the pressure within vessel 20 is in the range of about 10 psig to about 12 psig and the temperature is in the range of about 220° to about 240°. Vaporized solvent and non-solvent are withdrawn from pressure vessel 19 via conduit 18.

The fully formed fibrets, substantially free of solvent, are withdrawn from pressure vessel 19 as a slurry in the non-solvent, normally less than 2.0 weight percent solids, via conduit 21 and passed to a homogenizer vessel 22 wherein size reduction of the large fibrets can be effected. Size reduction can be accomplished by passing the dilute slurry through a narrow orifice with a high pressure drop. After homogenization, the slurry can be passed via conduit 23 to a non-solvent separator 24, such as a centrifuge, wherein the non-solvent is separated from the fibrets and withdrawn via conduit 27. Product pill-free fibrets, normally containing from about 65 to about 88 weight percent non-solvent are withdrawn from separator 24 via conduit 26.

The product fibrets of the invention can be used as filter aids and in the production of heavy weight paper. The fibrets because of their pill-free characteristics are particularly suitable in the production of fine paper, filtration paper, and lightweight nonwovens applications.

The invention is further illustrated by the following example.

EXAMPLE

A dilute fibret slurry comprising 0.44 weight percent cellulose acetate fibrets, 3.54 weight percent acetone and 96.2 weight percent water was passed to filter means 16. The slurry concentrate withdrawn from filter means 16 and passed to pressure vessel 19 comprised 2.00 weight percent cellulose acetate fibrets, 3.54 weight percent acetone and 94.46 weight percent water. The liquid stream withdrawn from filter means 16 comprised 3.5 weight percent acetone and 96.5 weight percent water.

Saturated steam was introduced into pressure vessel 19 via conduit 20 at a rate and temperature so as to achieve and maintain a temperature in vessel 19 of 230° F. Vessel 19 was pressurized to a pressure of 10 psig. A vaporized stream comprising 12.2 weight percent acetone and 87.8 weight percent water was withdrawn from vessel 19 via conduit 18. The fibret slurry withdrawn from vessel 19 via conduit 21 comprised 1.94 weight percent cellulose acetate and 98.06 weight percent water and was substantially free of chips and pills.

Although the invention has been described in detail with respect to specific embodiments, it should be noted that this invention is by no means limited to those specific embodiments.

What is claimed is:

1. A process for the production of fibrillar cellulose ester material, said fibrillar cellulose ester material produced thereby being substantially free of chips and pills, said process comprising the steps of:

providing a dope comprising a cellulose ester, a solvent for said cellulose ester, and a nonsolvent for said cellulose ester, said solvent and said nonsolvent being miscible;

attenuating said dope, under conditions of high shear, whereby a slurry of fibrillar cellulose ester material is formed;

thickening said slurry by the removal of a portion of said solvent and said nonsolvent; and separating said solvent from said thickened slurry by directly contacting said thickened slurry with saturated steam provided from a non-autogenous source.

2. The process according to claim 1 wherein said dope contains from about 5 percent to about 15 percent by weight of said cellulose ester.

3. The process according to claim 1 wherein a mixture of said solvent and said nonsolvent comprises of about 2 to about 20 weight percent of said nonsolvent.

4. The process according to claim 1 wherein said cellulose ester is cellulose acetate, said solvent is acetone, and said nonsolvent is water.

5. The process according to claim 1 further comprising the step of:

maintaining the temperature within a pressurized separation zone in the range of about 220° F. to about 240° F.

6. The process according to claim 1 further comprising the step of:

maintaining the pressure within a pressurized separation zone in the range of about 10 psig to about 15 psig.

7. The process according to claim 1 further comprising the step of:

homogenizing the fibrillar cellulose ester after contact with said saturated steam.

8. The process according to claim 7 further comprising the step of:

separating said nonsolvent from said homogenized fibrillar cellulose ester, thereby producing a final fibrillar cellulose ester containing about 65 to about 85 percent nonsolvent.

* * * * *